US006755797B1

(12) United States Patent
Stouffer

(10) Patent No.: US 6,755,797 B1
(45) Date of Patent: Jun. 29, 2004

(54) METHOD AND APPARATUS FOR PRODUCING OSCILLATION OF A BLADDER

(75) Inventor: Ronald D. Stouffer, Silver Spring, MD (US)

(73) Assignee: Bowles Fluidics Corporation, Columbia, MD (US)

( * ) Notice: Subject to any disclaimer, the term of this patent is extended or adjusted under 35 U.S.C. 154(b) by 0 days.

(21) Appl. No.: 09/713,328

(22) Filed: Nov. 16, 2000

Related U.S. Application Data

(60) Provisional application No. 60/167,695, filed on Nov. 29, 1999.

(51) Int. Cl.[7] ..... A61H 23/04
(52) U.S. Cl. ..... 601/149; 601/150; 601/152
(58) Field of Search ..... 601/148, 149, 601/151–153, 150; 137/853, 860

(56) References Cited

U.S. PATENT DOCUMENTS 2,684,672 A 7/1954 Summerville
4,175,297 A * 11/1979 Robbins et al. ..... 5/284
4,370,975 A * 2/1983 Wright ..... 128/64
4,582,081 A * 4/1986 Fillman ..... 137/218
4,657,536 A * 4/1987 Dorrman ..... 604/247
4,679,596 A * 7/1987 Olson ..... 137/853
5,109,832 A 5/1992 Proctor
5,197,461 A 3/1993 Petajan et al.

* cited by examiner

*Primary Examiner*—Danton D. DeMille
(74) *Attorney, Agent, or Firm*—Jim Zegeer

(57) ABSTRACT

An apparatus for producing oscillation of a bladder includes a three-legged fluid passage element which has first, second and third legs. An air pump is connected to one leg of the fluid passage element, an inflatable bladder connected to a second leg of the fluid passage element, and a valve having hysteresis is mounted on the third leg of the fluid passage element.

5 Claims, 3 Drawing Sheets

METHOD AND APPARATUS FOR PRODUCING OSCILLATION OF A BLADDER

REFERENCE TO RELATED APPLICATION

This application is the subject of provisional application Serial No. 60/167,695 filed Nov. 29, 1999 and entitled METHOD AND APPARATUS FOR PRODUCING OSCILLATION OF A BLADDER.

BACKGROUND AND BRIEF DESCRIPTION OF THE INVENTION

Devices to control the oscillatory inflation and deflation of bladders for massaging and the like purposes as well as for medical treatment are well known in the art. See Summerville U.S. Pat. No. 2,684,672; Proctor U.S. Pat. No. 5,109,832 and Petajan et al U.S. Pat. No. 5,197,461 and the references cited therein.

The object of the present invention is to produce oscillation (inflation and deflation) of a bladder for massaging and medical purposes using the principle of a venting relief valve which has a high hysteresis.

DESCRIPTION OF THE DRAWINGS

The above and other objects, advantages and features of the invention will become more apparent when considered with the following specification and accompanying drawings wherein.

DETAILED DESCRIPTION OF THE INVENTION

The present invention produces oscillation (inflation and deflation) of a bladder or flexible diaphragm useful in producing massaging and/or other medical treatments on the human body.

Figure 1:
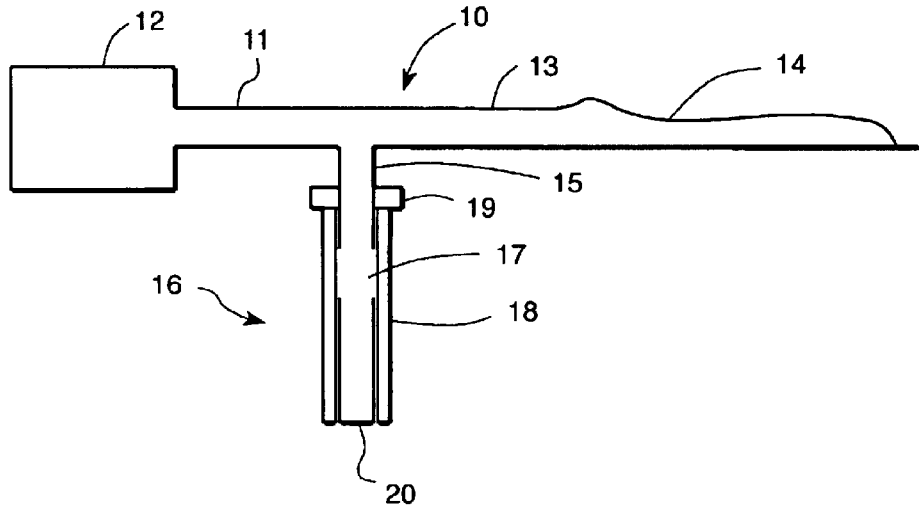
FIG. 1 is a diagrammatic illustration of a device for producing oscillation of a bladder incorporating the invention.

The principle of the invention is the use of venting relief valve which has a high hysteresis. Referring now to FIG. 1, a three-legged Y- or T-element has a first leg 11 connected to an air pump 12 and a second leg 13 connected to an inflatable bladder 14.

Figure 2:
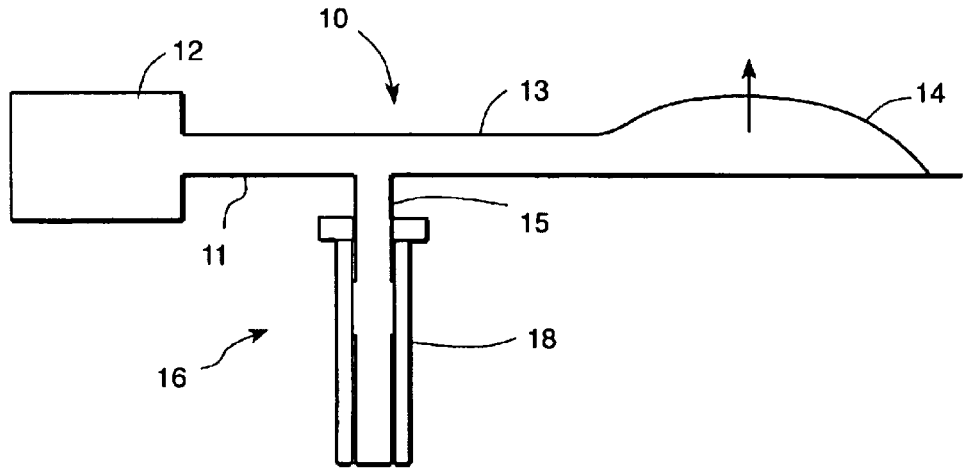
FIGS. 2–6 are diagrammatic illustrations of the invention showing it in different stages of operation.
Figure 3:
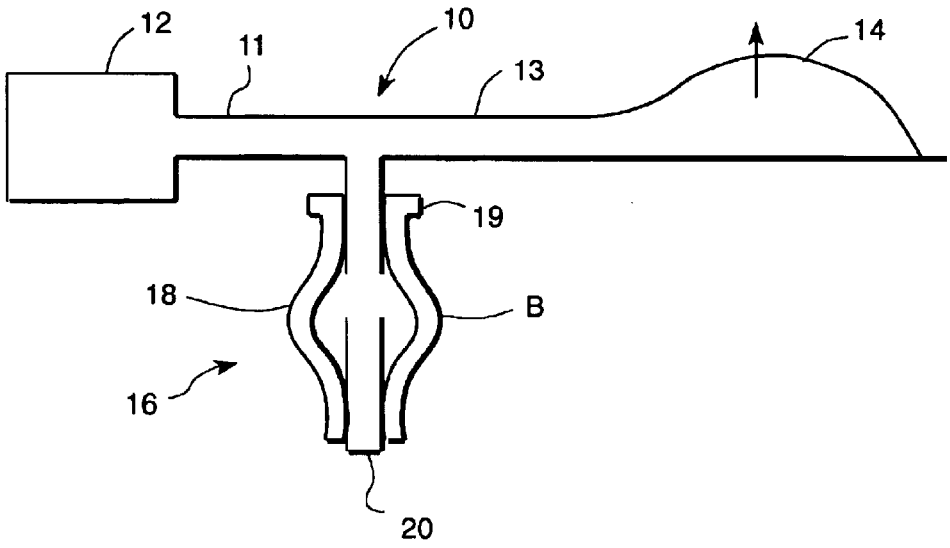
Figure 4:
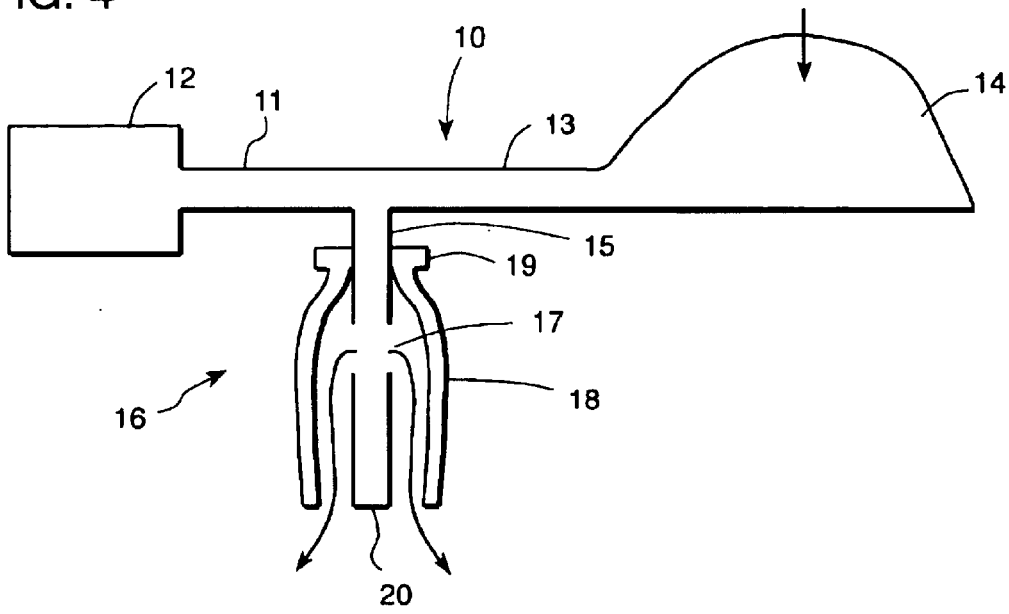
Figure 5:
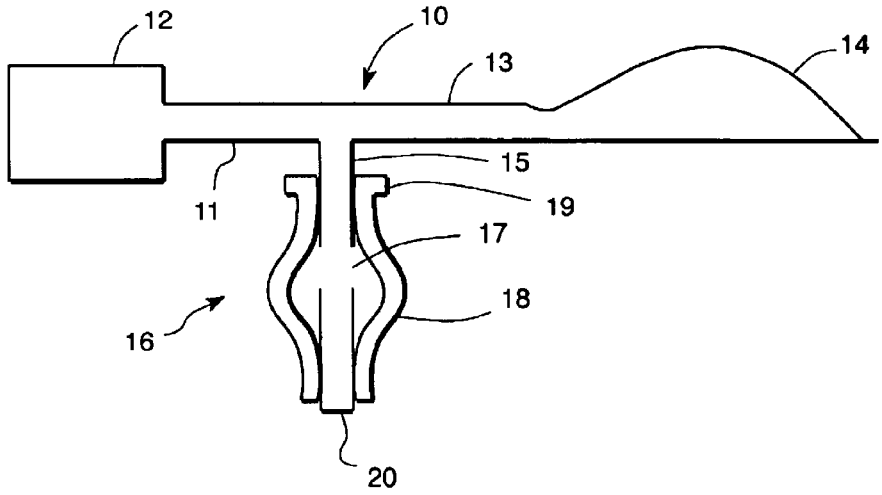
Figure 6:
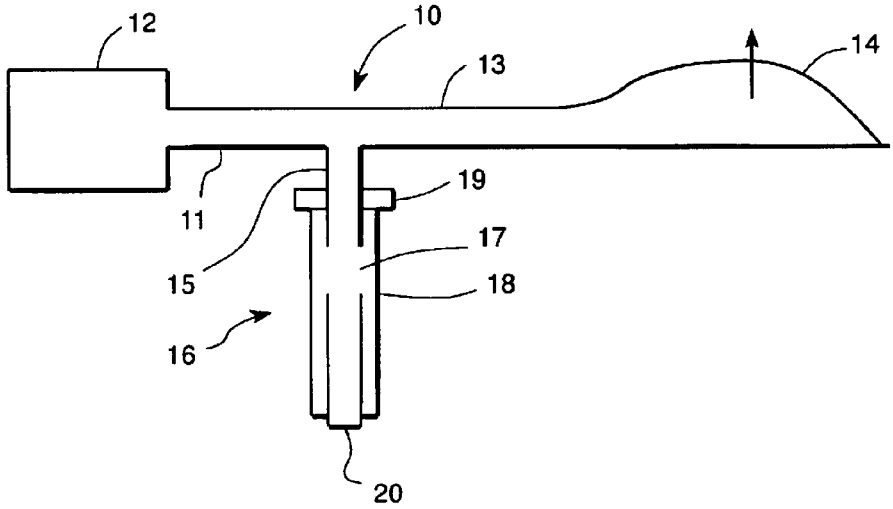

A third leg 15 is constructed in the form of a venting relief valve 16 which has a high hysteresis. As illustrated, the relief valve includes ports or openings 17 which are closed by an elastic sleeve 18 having an attachment band 19 for securing the elastic sleeve 18 on the leg 15, which has a closed end 20. As shown in FIG. 1, the sleeve seals the vent ports 17 and the bladder 14 is totally deflated. As shown in FIG. 2, the pump 12 is turned on, and the bladder 14 begins to inflate with the vent valve 16 still closed by the sleeve 18. FIG. 3 shows the sleeve 18 just starting to bulge as at B because of the build-up of pressure in the bladder. Between FIGS. 3 and 4, the increasing pressure has bulged more area under the sleeve 18 until in FIG. 4 the sleeve 18 opens to the atmosphere and vents the bladder 14. Because of the increased area under sleeve 18, it remains open to vent at a pressure less than it took to start to open it (e.g. to create the bulge). This area differential is what creates the hysteresis. Finally, FIGS. 5 and 6, the pressure is low enough for the sleeve to close the vents 17 and the cycle starts over again as in FIG. 2.

Various other forms of relief valve with hysteresis can be applied to vent the bladders in the system to cause the bladder to oscillate (inflate and deflate) as disclosed herein.

While a preferred embodiment of the invention has been shown, illustrated and described, it will be appreciated by those skilled in the art to other embodiments, adaptations and changes may be made to the invention without departing from the spirit and scope thereof as set out in the appended claims.

What is claimed is:

1. An apparatus for producing oscillation of a bladder comprising:

a three-legged fluid passage element having first, second and third legs, an air pump connected to one leg of said fluid passage element, an inflatable bladder connected to a second leg of said fluid passage element, and an oscillation producing venting relief valve having hysteresis on the third leg of said fluid passage element and producing oscillation of said bladder.

2. Apparatus as defined in claim 1 wherein said valve includes one or more ports in said third leg and an elastic sleeve closing said one or more ports.

3. A method for producing oscillation of a bladder comprising:

providing a three-legged fluid passage element having first, second and third legs, a pump connected to one leg of said element, an inflatable bladder connected to a second leg of said fluid passage element, and a venting relief valve having hysteresis on the third leg of said fluid passage element, and causing said pump to pressurize fluid in said fluid passage element.

4. A device for pulsating a bladder for massaging and medical uses comprising:

a three-legged fluid passage element which has first, second and third legs, an air pump connected to one leg of said fluid passage element, an inflatable bladder connected to a second leg of said fluidic passage element to provide said massaging and medical uses, a sleeve valve on said third leg, said sleeve valve being constituted by one or more vent ports and an elastic sleeve secured to said third leg, said elastic sleeve causing said relief valve to have a high hysteresis such that when the valve is closed by said sleeve, the bladder pressure builds up, inflating the bladder, and simultaneously, there is a build-up of pressure in said sleeve so that said sleeve starts to bulge, and as said pressure is increased, said bulge opens to the atmosphere and vents the bladder because the increased pressure in the sleeve causing it to remain open at less pressure than it took to start to open it and as the pressure on said sleeve decreases enough for the sleeve to close said one or more vent ports and restart said cycle.

5. A device for pulsating a bladder for massaging and medical purposes comprising:

a three-legged fluid passage element having first, second and third legs, an air pump connected to one leg of said fluid passage element, an inflatable bladder connected to a second leg of said fluidic passage element to provide said massaging and medical uses, a venting relief valve on said third leg, said venting relief valve being operable cyclically to cause cyclical pulsation of air pressure in said second leg and in said bladder.

* * * * *